US008161985B2

(12) United States Patent
Moran et al.

(10) Patent No.: US 8,161,985 B2
(45) Date of Patent: Apr. 24, 2012

(54) METHOD AND APPARATUS FOR CLEANING ARTICLES USED IN THE PRODUCTION OF SEMICONDUCTORS

(75) Inventors: Thomas J. Moran, Radolfzell-Stahringen (DE); Lutz Rebstock, Gaienhofen (DE)

(73) Assignee: Dynamic Microsystems Semiconductor Equipment GmbH, Radolfzell (DE)

( * ) Notice: Subject to any disclaimer, the term of this patent is extended or adjusted under 35 U.S.C. 154(b) by 1012 days.

(21) Appl. No.: 11/247,622

(22) Filed: Oct. 10, 2005 (Under 37 CFR 1.47)

(65) Prior Publication Data

US 2006/0185692 A1 Aug. 24, 2006

Related U.S. Application Data

(63) Continuation of application No. PCT/EP2004/003764, filed on Apr. 8, 2004.

(30) Foreign Application Priority Data

Apr. 11, 2003 (DE) ..... 103 17 275
Oct. 2, 2003 (DE) ..... 103 47 464

(51) Int. Cl.
*B08B 3/00* (2006.01)

(52) U.S. Cl. ..... 134/102.3

(58) Field of Classification Search ..... 134/102.3
See application file for complete search history.

(56) References Cited

U.S. PATENT DOCUMENTS

| | | | | |
|---|---|---|---|---|
| 2,972,352 | A * | 2/1961 | Ipsen | 134/57 R |
| 4,977,839 | A * | 12/1990 | Fochtman et al. | 110/346 |
| 5,156,173 | A * | 10/1992 | Keyser et al. | 134/61 |
| 5,173,258 | A * | 12/1992 | Childers | 422/27 |
| 5,499,642 | A | 3/1996 | Uchino | |
| 5,539,995 | A | 7/1996 | Bran | |
| 5,562,113 | A | 10/1996 | Thompson et al. | |
| 5,947,135 | A * | 9/1999 | Sumida et al. | 134/95.3 |
| 2001/0001392 | A1 * | 5/2001 | Hirae et al. | 134/1.3 |

FOREIGN PATENT DOCUMENTS

| | | | |
|---|---|---|---|
| DE | 33 39 565 | A1 | 5/1985 |
| DE | 42 08 665 | A1 | 9/1993 |
| DE | 103 17 275 | A1 | 11/2004 |
| EP | 0 405 941 | A2 | 1/1991 |
| EP | 0 454 873 | A1 | 11/1991 |
| WO | WO 95/29276 | | 11/1995 |
| WO | WO 02/17355 | A2 | 2/2002 |

* cited by examiner

*Primary Examiner* — Michael Barr
*Assistant Examiner* — David Cormier
(74) *Attorney, Agent, or Firm* — Harness, Dickey & Pierce, P.L.C.

(57) ABSTRACT

An apparatus and a method serve for cleaning articles used in the production of semiconductors, such as wafers, containers for transporting wafers (known as FOUPs), LCD substrates and photomasks. The articles are cleaned in a treatment chamber by means of a liquid and subsequently dried. A drying gas, such as air, is circulated within the treatment chamber and a condensation dryer is provided for extracting moisture from the gas.

21 Claims, 6 Drawing Sheets

METHOD AND APPARATUS FOR CLEANING ARTICLES USED IN THE PRODUCTION OF SEMICONDUCTORS

CROSSREFERENCE TO RELATED APPLICATIONS

This application is a continuation of co-pending international patent application PCT/EP2004/003764 filed on Apr. 8, 2004 and published in German language as WO 2005/001888 A2, which claims priority from national German patent applications DE 103 17 275.0 filed on Apr. 11, 2003 and DE 103 47 464.1 filed on Oct. 2, 2003.

BACKGROUND OF THE INVENTION

The present invention relates to a method and an apparatus for cleaning articles used in the production of semiconductors, and in particular to a method and an apparatus for cleaning semiconductor wafers, containers for transporting semiconductor wafers (Known as FOUPs), LCD substrates and photomasks.

In the semiconductor industry, various types of articles which are used in the production process need to be cleaned. These articles include auxiliaries, such as photomasks or containers for accommodating semiconductor products, but also semiconductor products themselves, such as wafers and LCD substrates. Therefore, when reference is made in the present application to "articles" that are to be cleaned, this is to be understood as meaning any of these articles.

Since these articles are typically cleaned by means of a liquid, they need to be dried at the end of the cleaning process. It is of great importance that the articles are completely cleaned during the cleaning step and that they are not contaminated again with foreign particles during the drying step. For the drying step, various procedures are known.

According to U.S. Pat. No. 5,562,113, drying of the articles is achieved by means of a stream of hot air. For this purpose, ambient air is sucked in, heated up, filtered and directed into the treatment chamber. This procedure has the disadvantage that, as a result of the external heating of the drying air, only a limited efficiency can be achieved. Furthermore, the supply of outside air always bears the risk that foreign particles are introduced into the treatment chamber although the air is filtered. This is because a compromise has to be made between the effectiveness of the filter on the one hand and the amount of air that can be passed through on the other hand.

In the case of other known apparatuses, which have been sold by the assignee under the type names 300 and 310, outside air is directed into the treatment chamber via a filter without heating-up. Instead, there are arranged infrared radiators inside the treatment chamber. Again, however, outside air is directed into the treatment chamber so that here too the problems mentioned above arise.

EP 0 454 873 A1 discloses a method for drying electronic components in which the components are cleaned in a chamber by means of water vapor. The water vapor condenses on a condenser and flows away as condensate via a line. Only subsequently the components are dried, namely by means of a drying gas, which is supplied from the outside. This method consequently has the same disadvantages as mentioned above, because here too foreign particles are unavoidably carried in by the drying gas.

DE 42 08 665 A1 discloses a method for drying machine parts which are contaminated with processing residues containing oil or grease. The machine parts are cleaned in a cleaning chamber by spraying with a cleaning liquid. For drying the machine parts, air is blown into the cleaning chamber and recirculated by a system of pipes to a blower. In the line between the blower and the cleaning chamber there is a steam/air heat exchanger. When cleaning machine parts, it does not cause any problems if there are foreign particles in the drying air supplied from the outside. For the purposes of the present invention, however, this is unacceptable for the reasons already mentioned above. In addition, an external drying air circuit with a separate condenser has a considerable space requirement.

A further method for cleaning heavy machine parts and an associated apparatus are described in WO 95/29276. In the case of this known method, a cleaning chamber of twice the normal height is provided. When cleaning, a container with machine parts is initially subjected to a cleaning liquid in a lower position in the chamber. After that, the container is raised into an upper position in the chamber and blasted with drying air. Here too, the drying air is circulated in a circuit in which a condenser is arranged. The disadvantages are therefore the same as described above.

SUMMARY OF THE INVENTION

Against this background, it is an object of the invention to provide an apparatus and a method for cleaning articles used in the semiconductor production process. In particular, it is an object to provide for an efficient drying of these articles with a reduced risk of contamination.

According to one aspect of the invention, this object is achieved by an apparatus for cleaning articles used in the production of semiconductors, having a treatment chamber in which the articles are cleaned by means of a liquid and subsequently dried, having an arrangement for moving a gas within the treatment chamber when it is closed, and having a condensation dryer connected to the treatment chamber, wherein the arrangement is adapted to circulate the gas within the closed treatment chamber to the condensation dryer.

According to another aspect, this object is achieved by a method for cleaning articles used in the production of semiconductors, wherein the articles are cleaned in a treatment chamber by means of a liquid and subsequently dried, a gas being circulated within the treatment chamber, with the treatment chamber being closed, and the gas being dried by means of a condensation dryer.

In contrast to the approaches known in the art, the entire drying operation takes place within the closed treatment chamber. This completely avoids the introduction of foreign particles, and with it contamination of the articles to be dried. As regards working in a closed treatment chamber, "closed" is to be understood as meaning that no gases are directed into the treatment chamber from the outside or directed out of it, once the cleaning process has started. Rather, the treatment chamber operates to this extent as a completely closed system. Furthermore, a condensation dryer which is preferably arranged in the treatment chamber itself, i.e. as an integral part of the treatment chamber, is provided for this purpose. The gas circulated in the treatment chamber is consequently dried in the treatment chamber itself, because the moisture constituents contained in the gas are condensed within the treatment chamber. Consequently, the moisture is extracted from the gas circulated in the treatment chamber, so that the articles are effectively dried.

In a preferred development of the apparatus, a heat exchanger is arranged near the treatment chamber and the condensation dryer is connected to the heat exchanger via a closed circuit.

This allows to operate the apparatus autonomously overall. It is not dependent on the supply and removal of external coolants.

According to another refinement, the condensation dryer may also be connected to an external coolant source via a supply line connection.

By contrast with the aforementioned alternative, this has the advantage that the apparatus-related expenditure is minimal, but on the other hand an external supply of coolant is required. Depending on the action time and costs of the coolant to be supplied (for example cooling water), one or the other variant will therefore be more advantageous in an individual case.

In the case of further exemplary embodiments of the invention, the condensation dryer has at least one condenser plate.

This measure has the advantage that the circulated air, laden with moisture, within the treatment chamber can flow directly along a relatively large surface area of the condenser plate, so that effective condensation, and with it drying, is possible.

It is preferred in this respect if a number of condenser plates are used, connected in a parallel arrangement to a supply line and, respectively, to a discharge line for a coolant.

This measure has the advantage that on the one hand a larger condensation area is available, on the other hand, as a result of the parallel connection, all the condenser plates are evenly cooled.

In this connection, furthermore, a good effect is achieved by the articles in the treatment chamber being arranged on a rotor which is rotatable about an axis, and the at least one condenser plate being arranged such that it is inclined by a predetermined angle in relation to a radial plane of the axis.

This measure has the advantage that a helical motion is imparted to the gas circulated in the treatment chamber, so that a defined circulation is obtained. Depending on the spatial arrangement of the condenser plates, this may lead to a laminar flow over the articles to be dried, for example whenever the obliquely arranged condenser plates are located in the band region of the treatment chamber.

In the case of a preferred refinement of this variant, guiding elements inclined in relation to the radial plane may be additionally arranged on an inner wall of the treatment chamber.

This measure has the advantage that the entire inner wall of the treatment chamber may be formed in the manner of a thread by the inclined condenser plates and the inclined guiding elements. This brings about a helical gas flow in the region of the chamber, which is completed by means of a counterflow directed axially in the center of the chamber.

In the case of embodiments of the apparatus according to the invention, spray nozzles for a cleaning or rinsing liquid are arranged on an inner wall of the treatment chamber. In the case of a treatment chamber that is of an essentially cuboidal form, the spray nozzles are preferably arranged in the region of corners of the treatment chamber.

Even more preferred, the articles in the treatment chamber are arranged on a rotor which is rotatable about a rotation axis and the axis runs essentially at the center of the treatment chamber. The spray nozzles are preferably directed toward the axis.

In the case of a refinement of the last-mentioned variant of the invention, at least one further spray nozzle is provided, which nozzle is kept in a retracted position outside the rotor when the rotor is rotating and can be moved in the radial direction into an advanced position, in the region of the articles held in the rotor, when the rotor is at a standstill.

This measure has the advantage that perfect cleaning is possible even in the case of articles of very large volume. This applies for example in the case of so-called FOUPs as are used in semiconductor fabrication for transporting a large number of wafers.

In the case of further embodiments of the invention, infrared radiators for drying the articles are provided in the treatment chamber. Alternatively or in addition to one another, one or more infrared radiators may be arranged at the center of the treatment chamber or on an inner wall of the treatment chamber. It is preferred, however, if the infrared radiators are not directed at the condensation dryer.

This measure has the advantage of avoiding heating-up of the condensation dryer, which would lead to a reduction of its efficiency.

In the case of further preferred embodiments of the apparatus according to the invention, the treatment space is essentially rectangular in horizontal section and is accessible via two doors, arranged in opposite side walls.

This measure has the advantage known per se that the articles can be loaded from one side of the apparatus and unloaded from the other side of the apparatus.

As an alternative to this, however, it is also possible for the treatment space to be essentially rectangular in horizontal section and accessible only via one door, arranged in one side wall.

This measure has the advantage that low apparatus-related expenditure is required for the apparatus.

In the case of a further embodiment of the invention, the articles in the treatment chamber are arranged on a rotor which is rotatable about an axis, the first means circulate the gas in the closed treatment chamber, and, furthermore, a condensation dryer for the gas and a cooler for cooling the condensation dryer are provided in the treatment chamber.

In the case of a corresponding variant of the method according to the invention, in which the articles in the treatment chamber are likewise arranged on a rotor which is rotatable about an axis, the treatment chamber is closed and the gas is circulated within the closed treatment chamber and dried by means of condensation, the condensation dryer being cooled at least before the beginning of the drying.

These measures have the advantage that the condensation dryer can remain switched off as long as the articles are being cleaned with hot liquids. This is so because, at the latest when they are thrown by centrifugal force from the articles rotated on the rotor, these hot liquids reach the condensation dryer and heat the heat exchanger medium located in it. If the condensation dryer were to continue running during this phase of the cleaning process, energy would be unnecessarily expended for cooling the heat exchanger medium. This would also mean that the condensation dryer has to be connected to a cooling unit with a very high cooling output.

In this connection, it should be mentioned that the heating output of the treatment chamber is typically of the order of 18 kW, while it would be desirable to provide the cooling unit that is assigned to the condensation dryer with an output of only approximately one tenth of this.

If a cooler for cooling the condensation dryer is provided, the temperature of the condensation dryer can be influenced in an active or passive way. In any event, the effect that, at the beginning of the drying operation, the condensation dryer is at a temperature which lies far below the temperature of the hot cleaning liquid is achieved according to the invention. Only in this way is it ensured that the condensation drying can commence to its full extent immediately, or at least within a very short time.

As already mentioned, the cooling of the condensation dryer can be brought about both in a passive way and in an active way.

In the case of the preferred exemplary embodiment of the invention, this passive cooling is achieved by a spray-protection wall arranged between the rotor and the condensation dryer.

This measure has the advantage that the heating-up of the condensation dryer by the thrown-off hot cooling liquid is prevented in the first place, because the thrown-off drops of the hot cleaning liquid do not come into contact with the condensation dryer in the first place because of the spray-protection wall arranged in between. As a result of this, the condensation dryer does not heat up, or only inappreciably, and is therefore available immediately at the beginning of the drying operation, or at least within a very short time, at its low operating temperature, in which a precipitation of the circulating moisture on the elements of the condensation dryer is brought about.

In the case of a preferred refinement of this exemplary embodiment, the spray-protection wall has fins, which are arranged in the manner of a Venetian blind.

This measure has the advantage that the air movement within the treatment chamber is not disturbed, or only minimally, by the spray-protection wall, but on the other hand the drops of the hot cleaning liquid that are thrown off from the rotating articles are intercepted by the fins of the Venetian-blind-like spray-protection wall.

In the case of a refinement of this variant of the invention, the condensation dryer has a plurality of condenser plates which are inclined by a predetermined angle in relation to the radial plane of an axis of rotation of the rotor, and the fins are arranged parallel to the condenser plates.

This measure firstly has the advantage that a helical motion is imparted to the gas or the air circulated in the treatment chamber, so that a defined circulation is obtained. Depending on the spatial arrangement of the condenser plates, this may lead to a laminar flow over the articles to be dried, for example whenever the obliquely arranged condenser plates are located in the edge region of the treatment chamber. The alignment of the fins parallel to the oblique arrangement of the condenser plates has in this case the advantage that they are also optimally protected in the oblique position mentioned.

In another variant, the condensation dryer is actively cooled. This preferably takes place by the cooler being formed as cooling spray nozzles directed at the condensation dryer.

This measure has the advantage that the cooling output of the cooling units, which for the reasons mentioned above is to be kept relatively low, does not have to be used for cooling the condensation dryer. Rather, the cold water that is installed anyway in the treatment chamber is used for the purpose of bringing about direct cooling of the condensation dryer via the cooling spray nozzles mentioned.

In the case of a second variant of active cooling of the condensation dryer, spray nozzles directed at the articles are arranged on an inner wall of the treatment chamber, and a controller is provided which firstly admits a cooling liquid to the spray nozzles and then sets the rotor in rotation.

This measure has the advantage that the spray nozzles that are expediently present in any case for the cleaning operation and are directed at the articles are also used for the direct cooling of the condensation dryer. A separate phase of the cleaning process, in which the articles are once again sprayed off with cold water after completed cleaning, is provided for this purpose. In this phase, the aforementioned downside is made an upside, in that cold water is applied to the articles and thrown off by centrifugal force during rotation, and in this way reaches the condensation dryer. The cooling is therefore brought about in precisely the same way as the heating-up was previously by the throwing-off of the hot cleaning liquid.

As already mentioned above, the apparatus and the method according to the invention can be used for cleaning different articles. To be mentioned with preference in this respect are containers for semiconductor products or semiconductor products themselves. Semiconductor products are in this case preferably wafers, LCD substrates or photomasks, without the invention being restricted to these specific semiconductor products.

It goes without saying that the features mentioned above and those still to be explained below can be used not only in the respectively specified combination but also in other combinations or on their own without departing from the scope of the present invention. Further advantages emerge from the description and the accompanying drawings.

BRIEF DESCRIPTION OF THE DRAWINGS

Exemplary embodiments of the invention are explained in more detail in the description which follows and are represented in the drawing, in which.

DESCRIPTION OF PREFERRED EMBODIMENTS

Figure 1:
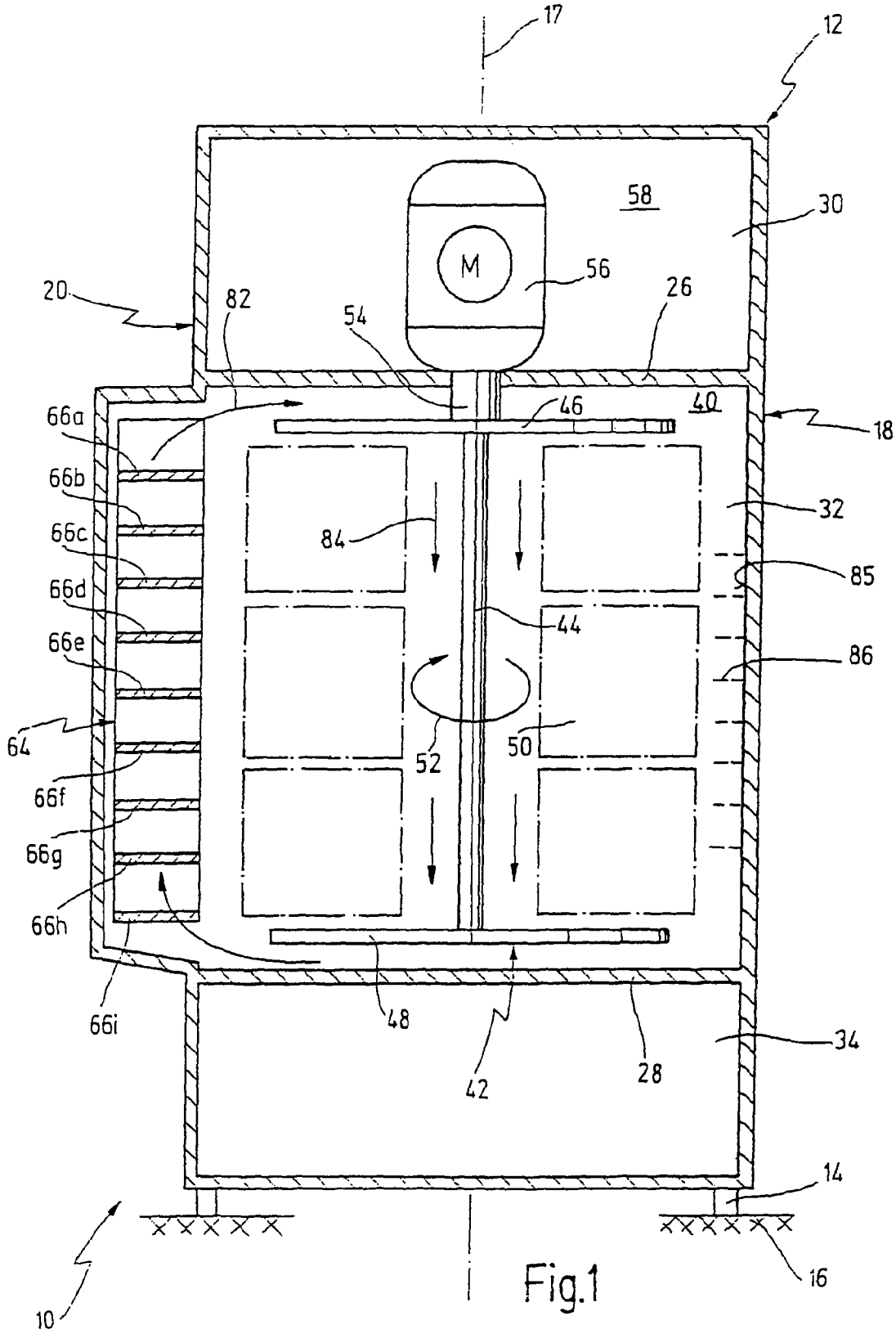
FIG. 1 shows a first exemplary embodiment of an apparatus according to the invention, in a side view, namely a sectional representation along the line I-I of FIG. 3.
Figure 2:
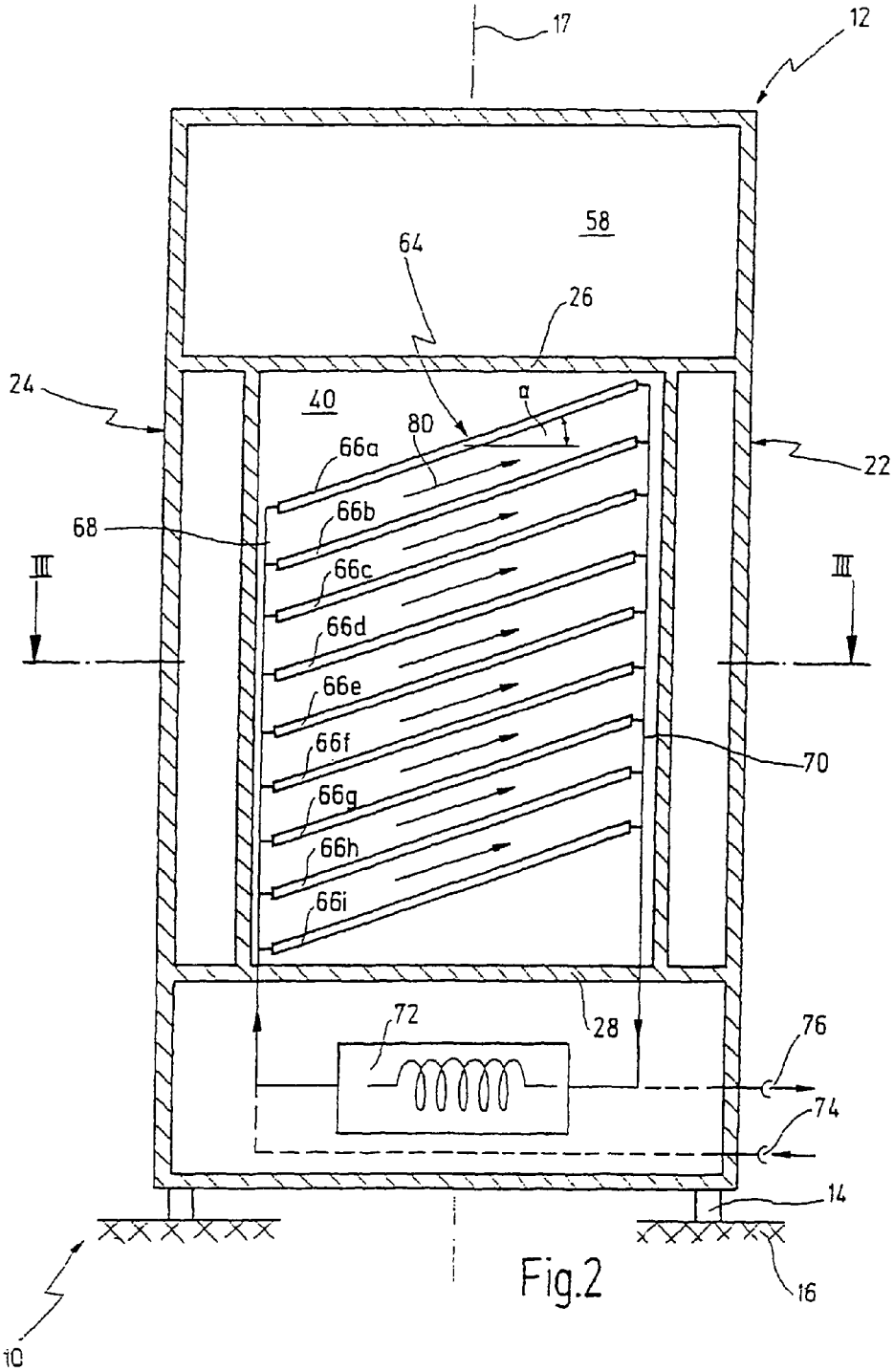
FIG. 2 shows the apparatus according to FIG. 1 in a side view turned 90°, likewise in section, along the line II-II of FIG. 3.
Figure 3:
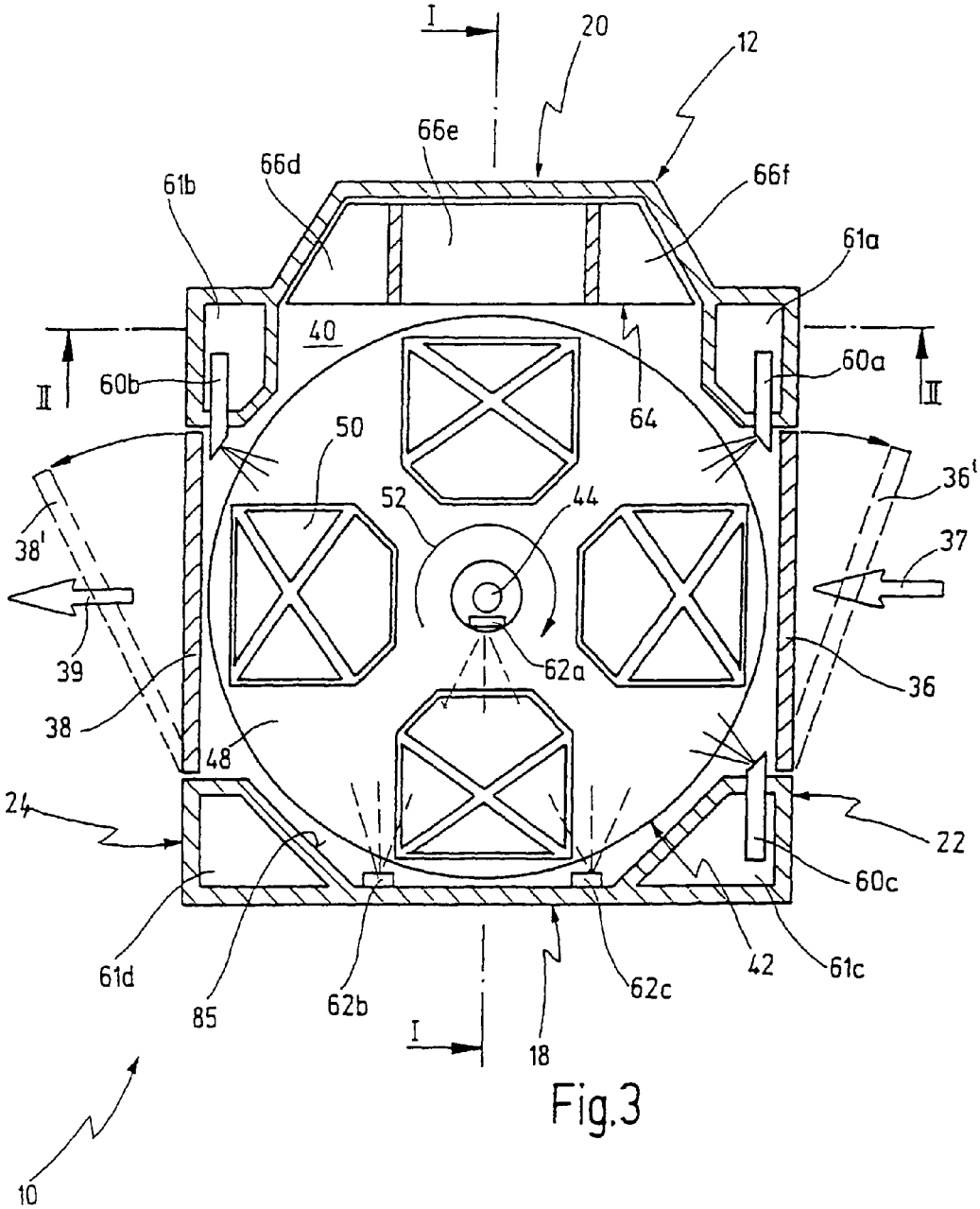
FIG. 3 shows a plan view of the apparatus according to FIGS. 1 and 2, likewise in section, along the line III-III of FIG. 2.

In FIGS. 1 to 3, reference numeral 10 designates a cleaning apparatus as a whole, for articles such as those used in the semiconductor industry for producing semiconductors.

The cleaning apparatus 10 has a cuboidal housing 12, which is arranged on a base 16 by means of feet 14. The housing 12 extends in the vertical direction along an axis 17. It has a front side wall 18, a rear side wall 20, a right-hand side wall 22 and a left-hand side wall 24. On the inside, the housing 12 is subdivided by an upper intermediate wall 26 and a lower intermediate wall 28. This creates an upper housing part 30, a middle housing part 32 and a lower housing part 34. It goes without saying that the representation in the figures is to be understood in this respect as only schematic. The details of the housing 12, connecting means and the like are not represented for the sake of overall clarity.

In the case of the exemplary embodiment according to FIGS. 1 to 3, the housing 12 is provided with two doors, that is with a right-hand door 36 in the right-hand side wall 22 and an opposite, left-hand door 38 in the left-hand side wall 24. It is indicated by arrows 37 and 39 that, with the doors open, as indicated by 36' and 38' for the state of partial opening, loading of the cleaning apparatus 10 by the throughput method is possible. For this purpose, for example, the articles that are to be cleaned are supplied in the direction of the arrow 37 through the open door 36 and the cleaned articles are removed in the direction of the arrow 39 through the open door 38.

The middle housing part 32 surrounds the treatment chamber 40. In the treatment chamber 40 there is a rotor 42, which can be driven by means of a shaft 44. The shaft 44 extends along the vertical axis 17. The rotor 42 has an upper holder 46 and a lower holder 48, between which the articles to be cleaned are held by means of suitable holding means.

In the exemplary embodiment represented, three levels of containers 50 are held between the holders 46 and 48. Provided on each level are a total of four containers 50, which are arranged respectively offset by 90° around the shaft 44. The containers 50 are containers such as those that are used for handling and transporting wafers or other semiconductor products.

As indicated by an arrow 52, the rotor 42 can be set in rotation. For this purpose, it is connected via a drive shaft 54 to a motor 56, which is located in a drive space 58 in the upper housing part 30. The direction of rotation of the motor 56 is preferably reversible.

As can be easily seen from FIG. 3, the housing 12 is essentially rectangular or cuboidal, at least in the region of the treatment chamber 40. In the corners 61*a*, 61*b*, 61*c*, 61*d* of the treatment chamber 40, in the exemplary embodiment represented in the three corners 61*a*, 61*b* and 61*c*, there are spray nozzles 60*a*, 60*b* and 60*c*. The spray nozzles 60*a* to 60*c* are directed toward the center of the treatment chamber 40, that is toward axis 17 or toward the shaft 44. The supply lines and supply devices of the spray nozzles 60*a* to 60*c* are known per se and are not represented for the sake of overall clarity.

Also located within the treatment chamber 40 are infrared radiators 62*a*, 62*b*, 62*c*. The infrared radiator 62*a* is in this case arranged in the region of the shaft 44, while the infrared radiators 62*b* and 62*c* are located on the front side wall 18. The infrared radiators 62*a* to 62*c* are likewise known per se and are therefore not represented in further detail.

According to the invention, a condensation dryer 64 is provided in the treatment chamber 40, namely in the region of the rear side wall 20. The condensation dryer 64 preferably comprises a number of condenser plates, in the exemplary embodiment represented by a total of nine condenser plates 66*a*, 66*b*, 66*c*, 66*d*, 66*e*, 66*f*, 66*g*, 66*h* and 66*i*. The condenser plates 66*a* to 66*i* are arranged such that they are inclined at a predetermined angle $\alpha$ with respect to a radial plane in relation to the axis 17, as can be easily seen from FIG. 2. The angle $\alpha$ lies for example between 10° and 30°, preferably at 20°.

The condenser plates 66*a* to 66*i* are connected on one side, in the exemplary embodiment represented on the respectively lower side, to a common supply line 68, and on their opposite side to a common discharge line 70, so that they are fluidically connected in parallel.

According to a first variant, the supply line 68 and the discharge line 70 are connected in a closed circuit to a heat exchanger 72. According to a second variant, the supply line 68 and the discharge line 70 are respectively connected to an external supply line connection 74 and a discharge line connection 76, so that the coolant can be externally supplied and removed.

The mode of operation of the cleaning apparatus 10 is as follows:

At the beginning of the cleaning method, the empty rotor 42 is loaded via the right-hand door 36. For this purpose, the rotor 42 is expediently rotated in four steps, by 90° each time, so that in each case three containers 30 can be loaded one above the other. This may take place manually or by means of a corresponding handling device, until finally all three levels are each loaded with four containers. It goes without saying in this respect that articles other than containers 50 can of course also be loaded, or that mixed loading may also be envisaged, in which for example the two lower levels are loaded with containers and the upper level is loaded with flat articles.

After completion of the loading operation, the right-hand door 36 is closed. The rotor 42 is then set in rotation by switching on the motor 56. At the same time, a cleaning liquid is directed at the articles that are to be cleaned, for example the containers 50, via the spray nozzles 60*a* to 60*c*. This cleaning operation may be followed by a rinsing operation, in which a rinsing liquid is sprayed on via the spray nozzles 60*a* to 60*c*. It goes without saying that different spray nozzles may also be used for supplying the cleaning liquid and a rinsing liquid.

In the case of a practical exemplary embodiment, the cleaning apparatus 10 has a cuboidal treatment chamber 40 with an edge length of 125 cm. The cleaning/rinsing is performed in two steps lasting for example 20 and 40 seconds, cleaned water at a temperature of 50° being used and the rotor 42 being rotated at 20 rpm.

The cleaning and possibly rinsing operation explained above is only followed by the drying operation of particular interest in the present context.

In order to dry the containers 50 effectively in the treatment chamber 40, the rotor 42 is firstly set in rapid rotation, for example 200 rpm, during two intervals lasting 30 seconds in each case. This rapid rotation of the rotor 42 brings about the effect that the cleaning or rinsing liquid located on the containers 50 is partly thrown off by centrifugal force.

Then a number of intervals during which the rotor 42 is rotated follow at a reduced rotational speed of between 30 and 60 rpm. This takes place during successive intervals, lasting for example sixty seconds, the direction of rotation of the rotor 42 being reversed between the individual intervals. Altogether, for example, twelve such intervals may be provided, it also being possible for the rotational speed of the rotor 42 to be raised or lowered in the meantime, depending on requirements. During these intervals, the infrared radiators 62*a*, 62*b* and 62*c* are switched on. These are preferably aligned in such a way that they do not radiate onto the condensation dryer 64, and consequently do not heat it up. The infrared radiation brings about a heating-up of the containers 50, which are thereby effectively dried.

The temperature in the treatment chamber 40 is preferably kept at a constant temperature, for example at 55° C., during the entire cleaning and drying operation. The overall duration of the operation is preferably around ten to twelve minutes.

During the drying operation, the rotation of the rotor 42 brings about the effect that the gas, for example the air, within the closed treatment chamber 40 is circulated. The oblique position of the condenser plates 66*a* to 66*i* (cf. FIG. 2) has the effect that a helical motion component is imparted to the gas flow in the region of the rear side wall 20. This is indicated in FIG. 2 by arrows 80. This helical motion of the gas in the wall region leads to a radially directed flow in the region of the base and top, as indicated by arrows 82 in FIG. 1. The flow is then completed by an axial flow in the region of the shaft 44, as illustrated in FIG. 1 by an arrow 84.

A reversal of the direction of rotation of the rotor 42 also has the result in this case of a reversal of the direction of flow (arrows 80, 82 and 84). The reversal of the direction of rotation of the rotor 42 also brings about the effect in particular that, during the momentary standstill of the rotor 42, as the movement passes through zero, those fractions of the liquid that are located in corners, blind holes or the like of the containers 50 can run out under the influence of gravity, in order then to be dried off in the subsequent drying interval.

In FIG. 1, it is also indicated by 86 that an inner wall 85 of the front side wall 18 is provided with guiding elements 86, in order to assist the helical directing of the gas within the treatment chamber 40. It goes without saying that such guiding elements 86 may also be provided on the other inner walls of the treatment chamber 40.

Figure 4:
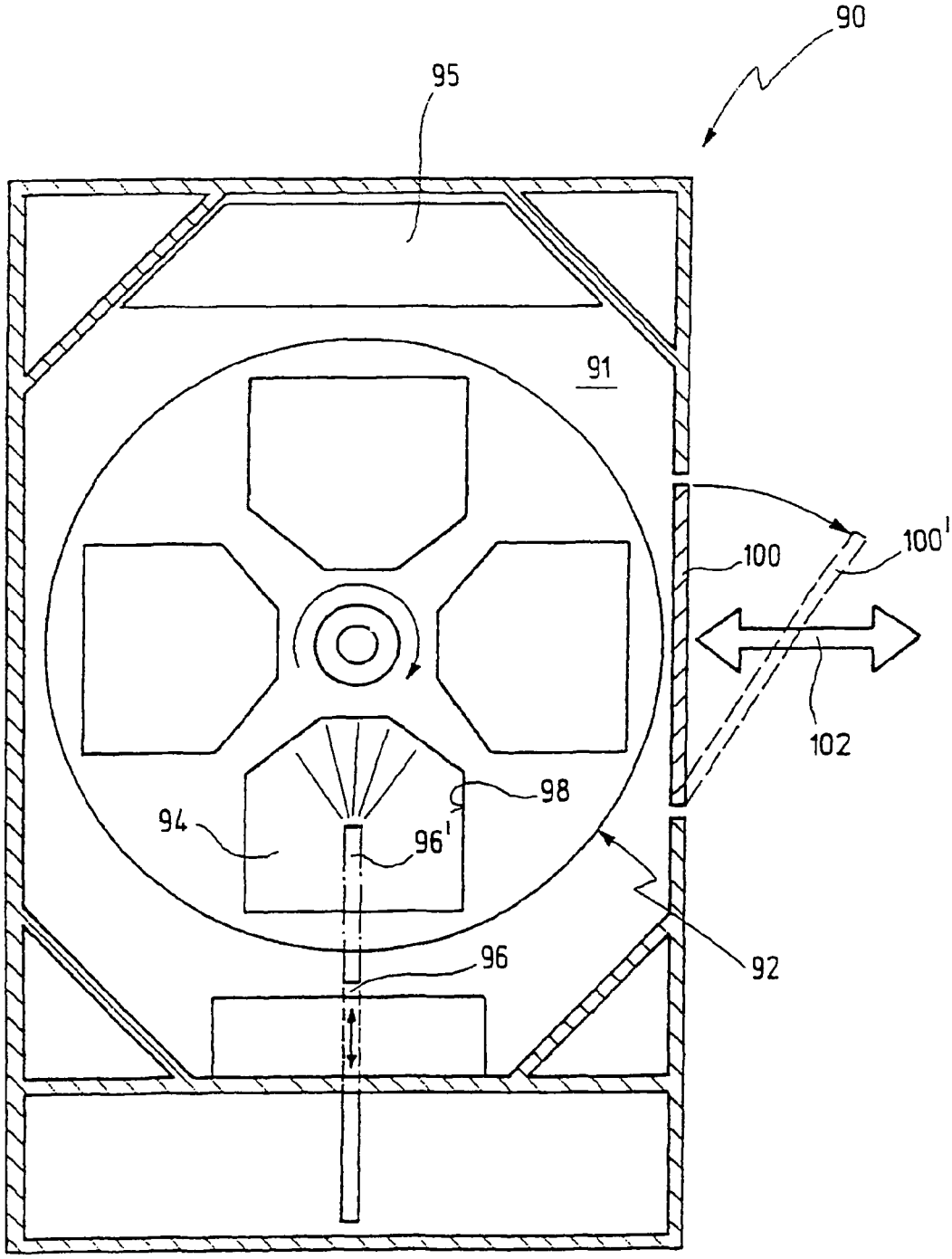
FIG. 4 shows a representation similar to FIG. 3, but for a second exemplary embodiment of an apparatus according to the invention.

FIG. 4 shows a further exemplary embodiment of the invention with a cleaning apparatus 90 and a treatment chamber 91, which is rectangular in plan view. Here too, a rotor 92 for containers 94 is provided in the treatment chamber 91, and similarly a condensation dryer 95. To this extent, this embodiment coincides with the exemplary embodiment according to FIGS. 1 to 3.

What is special about the exemplary embodiment according to FIG. 4 is as follows:

On the one hand, the cleaning apparatus 90 is provided with a further spray nozzle 96. In the position depicted by solid lines in FIG. 4, this spray nozzle 96 is located in a retracted position outside the path of movement of the rotor 92, so that the latter can rotate undisturbed by the spray nozzle 96.

In order then also to be able to clean inner sides 98 of the containers 94 effectively, the rotor 92 can be stopped, during or at the end of the cleaning operation, in a rotational position in which a container 94 or a number of containers 94 arranged one above the other is/are located directly in front of the spray nozzle 96 or a number of spray nozzles 96 arranged one above the other. The spray nozzle 96 then advances into the advanced position, depicted by dash-dotted lines in FIG. 4, in order to spray out the inner side 98 of the container 94 with the rotor 92 at a standstill. The spray nozzle 96 then retracts again, the rotor 92 rotates by 90° and the spray nozzle 96 advances again, in order to spray out the next container 94 of the same level on its inner side, and so on.

In this way, the containers 94 are therefore cleaned, and possibly rinsed, extremely effectively not only on the outside but also on the inside.

The second special feature of the exemplary embodiment according to FIG. 4 is that only one door 100 is provided in a side wall. A double-headed arrow 102 symbolizes in FIG. 4 that in this case both the loading and the unloading of the containers 94 takes place through the same door 100 in its open state 100'.

Figure 5:
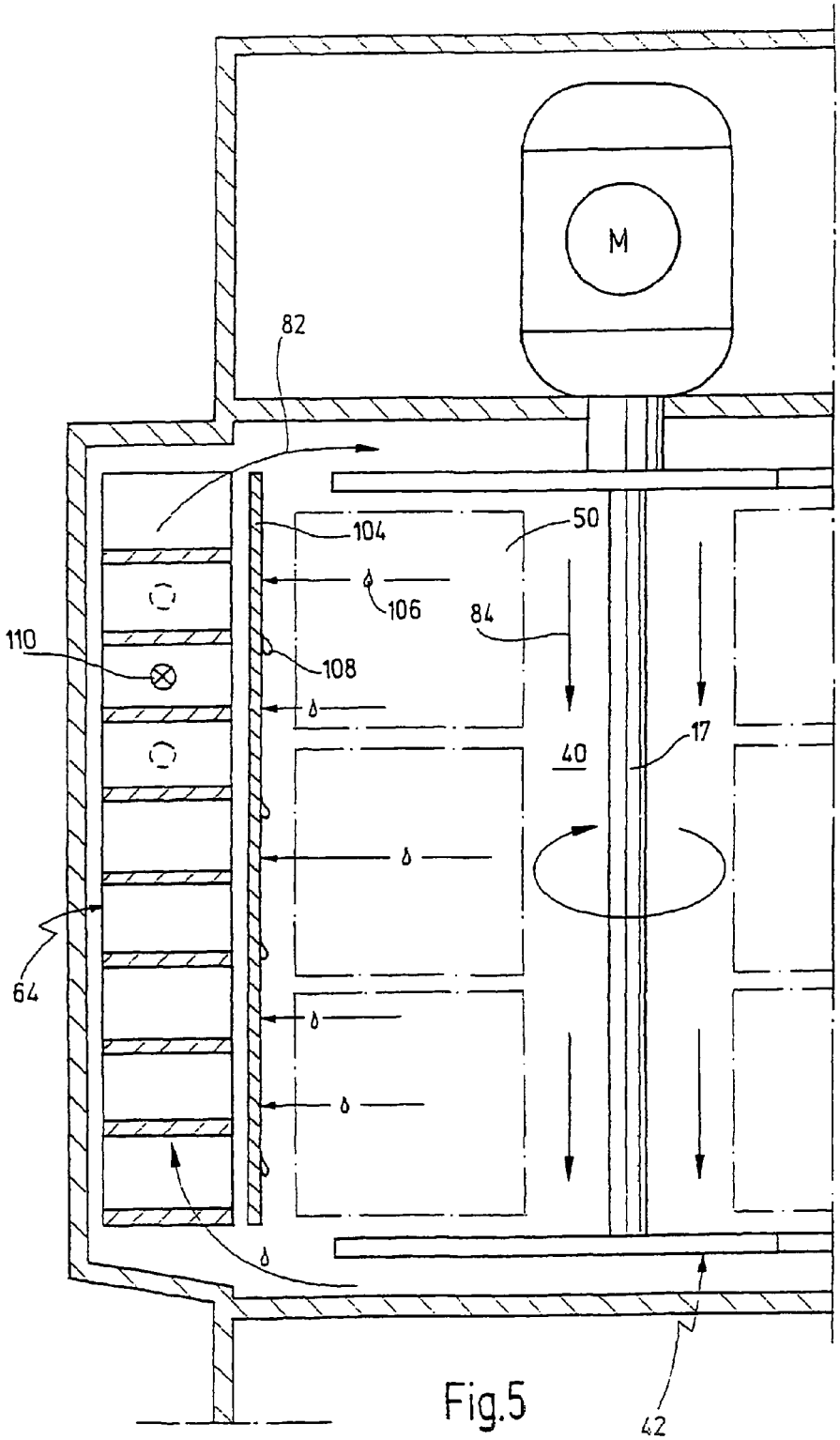
FIG. 5 shows a detail from FIG. 1 on a somewhat enlarged scale, but for a variant of a device according to the invention of a spray-protection wall.

FIG. 5 shows an enlarged detail from the representation according to FIG. 1, but in a modified representation to explain exemplary embodiments of the invention.

As can be easily seen from FIG. 5, a spray-protection wall 104 is provided between the rotor 42 and the condensation dryer 64. This spray-protection wall 104 may be formed for example as a continuous sheet-metal plate.

Once the containers 50 have been sprayed with hot cleaning liquid during a cleaning operation, they are completely wetted with this hot cleaning liquid. If the rotor 42 then rotates at high speed, drops 106 are thrown off from the containers 50 by the effect of centrifugal force, namely radially outward, where they meet the spray-protection wall 104. The drops 108 arriving there run down on the spray-protection wall 104 and are collected in the bottom region of the treatment chamber and disposed of.

This measure has the following purpose: If the spray-protection wall 104 is not present, the drops 106 fly unhindered onto the condensation dryer 64 and heat up its fins. The condensation dryer 64 would therefore either have to be constantly cooled or at least firstly cooled down at the end of the cleaning operation before it again reaches the low operating temperature required for the condensation drying.

This direct heating of the condensation dryer 64 is passively prevented according to the invention by the provision of the spray-protection wall 104, because the hot drops 106 do not reach the condensation dryer 64.

In the case of an alternative or additional procedure, the condensation dryer 64 may also be cooled directly. This takes place for example by means of cooling spray nozzles, only one of which is depicted in FIG. 5 by solid lines at 110. It goes without saying that it is also possible for a number of such cooling spray nozzles 110, in particular in each case one or two, to be provided for each fin of the condensation dryer 64.

The cooling spray nozzles 110 can be provided irrespective of whether or not a spray-protection wall 104 is provided. The cooling spray nozzles 110 are switched on when the cleaning operation is completed and bring about direct cooling of the fins of the condensation dryer 64 by heat removal.

A corresponding effect can be achieved in the case of a further variant of the invention by working without a spray-protection wall 104. After completion of the cleaning operation, the containers 50 are sprayed with a cold liquid, which is thrown off by rotation of the rotor 42 in precisely the same way as described further above for the case of a hot cleaning liquid. In this case, the condensation dryer 64 is subjected to thrown-off cold drops of the cleaning liquid and likewise actively cooled in this way.

If a spray-protection wall 104 is provided, it is of course intended not to hinder, or to hinder as little as possible, the desired flow of the gas and of the air in the treatment chamber, which is indicated in an arrow 82.

Figure 7:
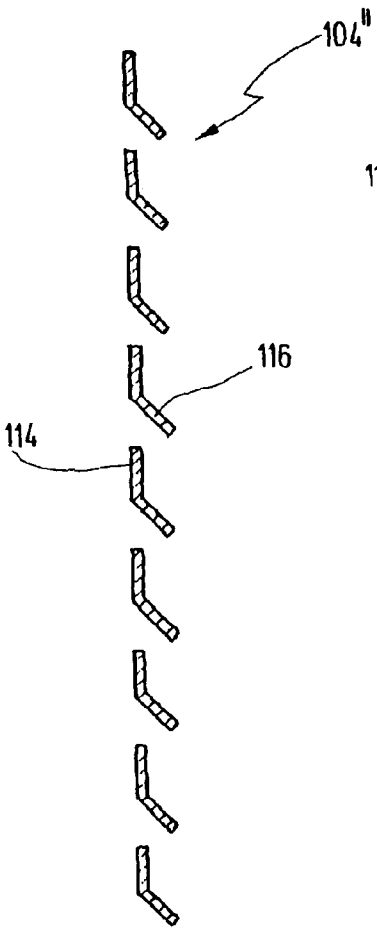
FIG. 7 shows a representation similar to FIG. 6, for a further variant of a Venetian-blind-like spray-protection wall.
Figure 6:
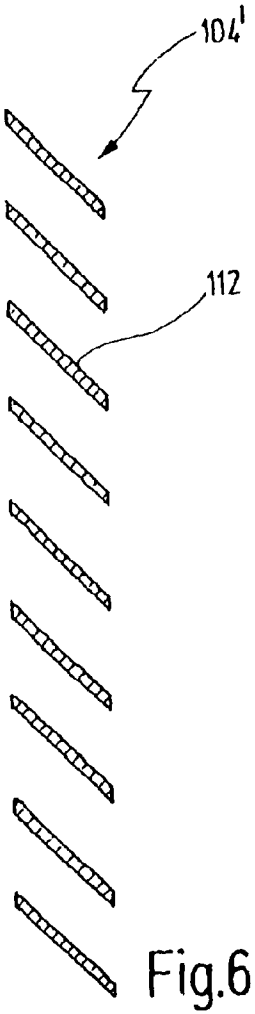
FIG. 6 shows an extremely schematized lateral sectional representation of a first examplary embodiment of a Venetian blind-like spray-protection wall.

For this reason, it is particularly preferred within the scope of the present invention if the spray-protection wall 104 is formed like a Venetian blind, as represented in two variants in FIGS. 6 and 7.

FIG. 6 shows a first variant of a spray-protection wall 104' with obliquely positioned individual fins 112.

Figure 8:
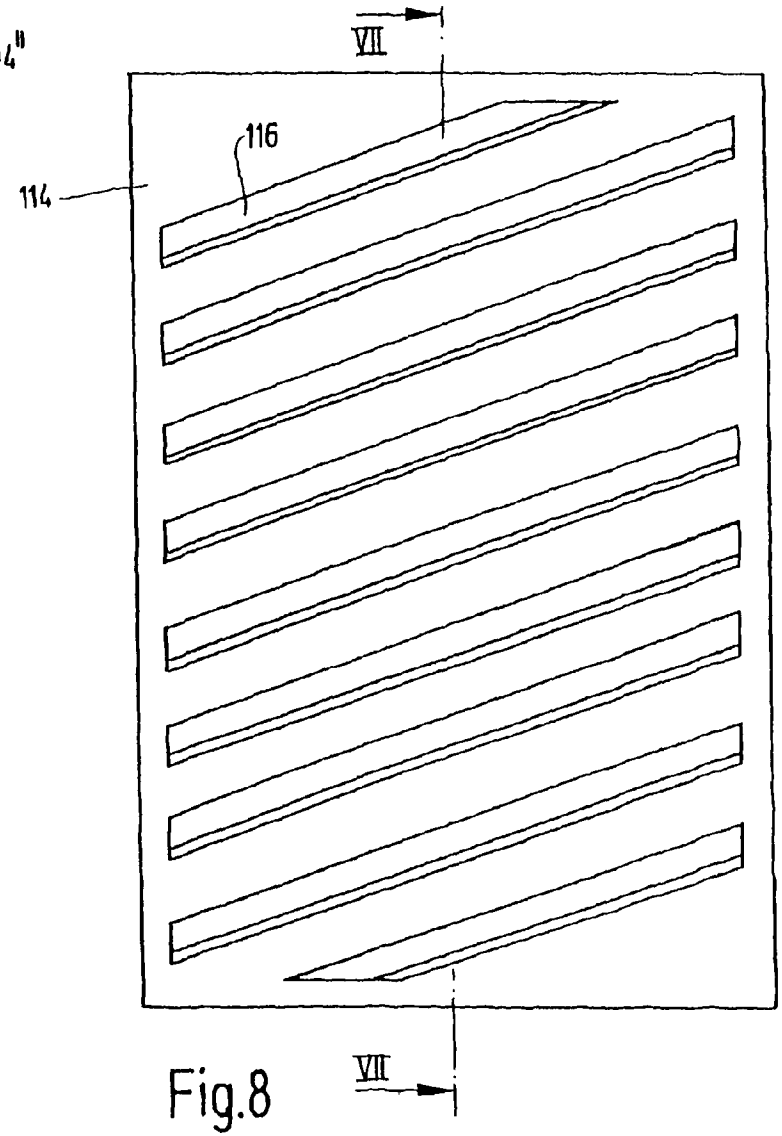
FIG. 8 shows a view of the spray-protection wall from FIG. 7 from the side, the illustration according to FIG. 7 being a sectional representation along the line VII-VII of FIG. 8.

FIG. 7 shows another variant of a spray-protection wall 104", in which fin-like elements 116 are punched out from a continuous metal sheet 114, which is also clearly represented in FIG. 8, and are bent away, which makes easier production and assembly possible, as compared with the exemplary embodiment according to FIG. 6.

In FIG. 8, it can additionally be seen that the fin-like elements 116 are arranged such that they are inclined in relation to a radial plane of the rotor 42, to be specific by the same angle $\alpha$ as the fins of the condensation dryer 64 (cf. in this respect FIG. 2 with associated description).

It goes without saying that the invention is not restricted to the exemplary embodiments set out above.

The invention claimed is:

1. An apparatus for cleaning and drying articles selected from a group containing semiconductor wafers, containers for transporting semiconductor wafers, LCD substrates and photomasks, comprising:

a closed treatment chamber adapted to accommodate the articles while they are cleaned, and adapted to accommodate a gaseous medium, a rotor being arranged in the treatment chamber for rotatably holding the articles while they are cleaned and dried, at least one spray nozzle arranged in the treatment chamber for spraying a cleaning or rinsing liquid onto the articles, a condensation dryer arranged in the treatment chamber for drying the articles, the condensation dryer being adapted to condense and extract from the gaseous medium moisture from the articles that is absorbed by the gaseous medium while it is circulated as a closed-loop gas flow within the treatment chamber, and a spray-protection wall arranged between the rotor and the condensation dryer in order to prevent cleaning or rinsing liquid from being splashed against the condensation dryer.

2. The apparatus of claim 1, wherein the rotor defines a rotation axis and a radial plane perpendicular to the rotation axis, and wherein the condensation dryer comprises condenser elements which are obliquely arranged with respect to the radial plane.

3. The apparatus of claim 1, wherein the spray-protection wall has fins which are arranged in the manner of a Venetian blind.

4. An apparatus for cleaning and drying articles used in the production of semiconductors, having a closable treatment chamber in which the articles are cleaned by means of a liquid and subsequently dried by a gas, having an arrangement for moving the gas within the treatment chamber when it is closed, so that a closed-loop gas flow within the treatment chamber results, and having a condensation dryer arranged in the treatment chamber, wherein the arrangement is adapted to circulate the gas within the closed treatment chamber to the condensation dryer, and wherein the condensation dryer is configured for extracting from the gas moisture from the articles that is absorbed by the gas during the drying process in order to dry the gas.

5. The apparatus of claim 4, further comprising a coolant supply line and a coolant discharge line connected to the condensation dryer for supplying and discharging a coolant into and out of the condensation dryer.

6. The apparatus of claim 5, further comprising a heat exchanger arranged outside the treatment chamber, the condensation dryer being connected to the heat exchanger via the coolant supply line and the coolant discharge line in a closed circuit fashion.

7. The apparatus of claim 5, further comprising an external coolant source for continuously providing a coolant, the condensation dryer being connected to the coolant source via the coolant supply line in an open circuit fashion.

8. The apparatus of claim 5, wherein the condensation dryer has a number of condenser elements connected in a parallel arrangement to the coolant supply line and the coolant discharge line.

9. The apparatus of claim 8, wherein the condenser elements are condenser plates.

10. The apparatus of claim 8, further comprising a rotor arranged in the treatment chamber for rotatably holding the articles, the rotor defining a rotation axis and a radial plane perpendicular to the rotation axis, wherein the condenser elements are arranged with a predetermined inclination angle relative to the radial plane.

11. The apparatus of claim 10, wherein the treatment chamber further comprises an inner wall and gas flow guiding elements arranged on the inner wall with an inclination relative to the radial plane.

12. The apparatus of claim 10, further comprising a spray-protection wall arranged between the rotor and the condensation dryer.

13. The apparatus of claim 12, wherein the spray-protection wall has fins which are arranged in the manner of a Venetian blind.

14. The apparatus of claim 13, wherein the fins are arranged parallel to the condenser elements.

15. The apparatus of claim 10, further comprising spray nozzles for spraying a cleaning or rinsing liquid, wherein the treatment chamber is of an essentially cuboidal form having inner corners and wherein at least some of the spray nozzles are arranged in the region of the inner corners.

16. The apparatus of claim 15, wherein the spray nozzles comprise at least one spray nozzle which is kept in a retracted position outside the rotor when the rotor is rotating and which can be moved into an advanced position projecting into the rotor, when the rotor is at a standstill.

17. The apparatus of claim 15, wherein at least one spray nozzle is adapted to be directed toward the condensation dryer.

18. The apparatus of claim 15, further comprising a controller configured to control the apparatus in such a way that a cooling liquid is admitted to the spray nozzles and then the rotor is set in rotation.

19. The apparatus of claim 4, further comprising infrared radiators arranged in the treatment chamber for drying the articles.

20. The apparatus of claim 19, wherein the infrared radiators are directed away from the condensation dryer.

21. The apparatus of claim 4, wherein the articles are selected from a group comprising wafers, containers for transporting and cleaning wafers, LCD substrates and photomasks.

* * * * *